United States Patent [19]

Maekawa et al.

[11] Patent Number: 4,530,893

[45] Date of Patent: Jul. 23, 1985

[54] ONE-COMPONENT TYPE RED COLOR MAGNETIC DEVELOPER

[75] Inventors: Kouji Maekawa, Kyoto; Nobuhiro Miyakawa, Abiko, both of Japan

[73] Assignee: Mita Industrial Co. Ltd., Osaka, Japan

[21] Appl. No.: 556,193

[22] Filed: Nov. 29, 1983

[30] Foreign Application Priority Data

Nov. 30, 1982 [JP] Japan ..... 57-208690

[51] Int. Cl.[3] ..... G03G 9/08

[52] U.S. Cl. ..... 430/106; 430/106.6; 430/903; 252/62.54; 252/62.56

[58] Field of Search ..... 430/106, 106.6, 137, 430/903; 252/62.54, 62.56

[56] References Cited

U.S. PATENT DOCUMENTS 4,031,021 6/1977 Deming ..... 252/62.54 X
4,443,527 4/1984 Heikens et al. ..... 430/106.6 X
4,448,870 5/1984 Imai et al. ..... 430/106.6 X

FOREIGN PATENT DOCUMENTS 51-42539 4/1976 Japan ..... 430/106
53-118052 10/1978 Japan ..... 430/106.6

*Primary Examiner*—Roland E. Martin
*Attorney, Agent, or Firm*—Sherman & Shalloway

[57] ABSTRACT

Disclosed is a one-component type red color magnetic developer having a self-electroscopic property, which comprises particles prepared from a kneaded composition comprising 100 parts by weight of a magnetic powder composed mainly of ocherous gamma-type diiron trioxide, 2.5 to 30 parts by weight of a red azo pigment and 40 to 200 parts by weight of a binder resin, wherein a fixed image of the particles is measured by a color difference meter, the value x is from 0.51 to 0.73, the value y is from 0.22 to 0.40 and the value Y is from 5 to 65%.

9 Claims, No Drawings

ONE-COMPONENT TYPE RED COLOR MAGNETIC DEVELOPER

BACKGROUND OF THE INVENTION (1) Field of the Invention:

The present invention relates to a one-component type red color magnetic developer. More particularly, the present invention relates to a one-component type red color magnetic developer having a self-electroscopic property, which comprises particles prepared from a kneaded composition comprising 100 parts by weight of a magnetic powder composed mainly of ocherous gamma-type diiron trioxide, 2.5 to 30 parts by weight of a red azo pigment and 40 to 200 parts by weight of a binder resin, wherein a fixed image of the particles is measured by a color difference meter, the value x is from 0.51 to 0.73, the value y is from 0.22 to 0.40 and the value Y is from 5 to 65%.

(2) Description of the Prior Art:

In the field of the electrophotographic reproduction, there have been proposed various multi-color developing processes in which a peculiar portion of a print, for example, a portion to which an attention should be paid, is developed in a color hue different from that of other portions, for example, a red color.

In case of a so-called two-component type developer among developers used in these multi-color developing prccesses, since toner particles are prepared by kneading a pigment and a resin, separately from a magnetic carrier, the hue of the toner and various developing characteristics are substantially satisfactory. However, in case of a one-component type developer, since a powder of a magnetic material has to be incorporated into developer particles, the hue of the toner and the developing properties are insufficient.

For example, magnetite (triiron tetroxide) which is a magnetic material excellent in the magnetic characteristics is black, and even if a coloring pigment, for example, a red pigment, is incorporated together with this magnetic material, the hue of the developer is blackish and the developer image is obscure.

It is known that magnetite particles are mixed with titanium dioxide to hide and erase the black color of the magnetite particles and a pigment of a desirable hue is further incorporated to form a one-component type color developer. However, when it is intended to sufficiently hide and erase the black color and obtain a desirable color, the magnetic attracting force of the developer is weakened and such troubles as scattering of the toner and fogging in a print are caused.

SUMMARY OF THE INVENTION

It is therefore a primary object of the present invention to provide a one-component type red color magnetic developer in which the above-mentioned defects are eliminated and which is excellent in the combination of the hue of the formed image and the magnetic and developing characteristics.

Another object of the present invention is to provide a one-component type red color magnetic developer which can give a red image much clearer than red images of the conventional red developers, without such troubles as fogging and scattering of the toner.

More specifically, in accordance with the present invention, there is provided a one-component type red color magnetic developer having a self-electroscopic property, which comprises particles prepared from a kneaded composition comprising 100 parts by weight of a magnetic powder composed mainly of ocherous gamma-type diiron trioxide, 2.5 to 30 parts by weight of a red azo pigment and 40 to 200 parts by weight of a binder resin, wherein a fixed image of the particles is measured by a color difference meter, the value x is from 0.51 to 0.73, the value y is from 0.22 to 0.40 and the value Y is from 5 to 65%.

DETAILED DESCRIPTION OF THE PREFERRED EMBODIMENTS

In the developer of the present invention, a magnetic material composed mainly of ocherous gamma-type diiron trioxide is selected and used among various magnetic materials. This diiron trioxide is of the gamma-type and has excellent magnetic characteristics, and this diiron trioxide is ocherous and has a reduced tendency to color developer particles in a dark inherent hue and is characterized in that when this diiron trioxide is combined with a red azo pigment described hereinafter, a sharp red image can be provided.

The ocherous gamma-type diiron trioxide has a number average particle size of 0.2 to 2 microns, especially 0.2 to 1 micron.

The ocherous gamma-type diiron trioxide suitable for attaining the objects of the present invention is commercially available and supplied under the tradename of "Mapico TAN T-10" or "Mapico TAN T-20" by Titanium Kogyo Kabushiki Kaisha.

In the present invention, a red azo pigment is used as the coloring pigment. As preferred examples of the red azo pigment, there can be mentioned Pigment Red 1 (C.I. 12070), Pigment Red 2 (C.I. 12310), Pigment Red 3 (C.I. 12120), Pigment Red 5 (C.I. 12490), Pigment Red 7 (C.I. 12420), Pigment Red 11 (C.I. 12430), Pigment Red 12 (C.I. 12385), Pigment Red 13 (C.I. 12395), Pigment Red 14 (C.I. 12380), Pigment Red 48 (C.I. 15865), Pigment Red 49 (C.I. 15630), and Pigment Red 60 (C.I. 16015 Lake). Of course, red azo pigments that can be used in the present invention are not limited to those exemplified above.

In the present invention, these red azo pigments may be used singly or in the form of mixtures of two or more of them. If necessary, the red azo pigment may be used in combination with other coloring pigment or white pigment.

Any of various thermoplastic and thermosetting resins customarily used in this field may be used as the binder medium in the present invention. Ordinarily, homopolymers and copolymers of mono-ethylenically or diethylenically unsaturated monomers, especially (a) vinyl aromatic monomers and (b) acrylic monomers, are used.

As the vinyl aromatic monomer, there can be mentioned monomers represented by the following formula:

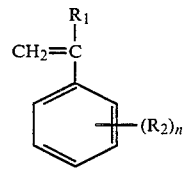

wherein $R_1$ stands for a hydrogen atom, a lower alkyl group (having up to 4 carbon atoms) or a halogen atom, $R_2$ stands for a lower alkyl group, a halogen atom or other substituent, and n is an integer of up to 2 inclusive of 0, such as styrene, vinyl toluene, α-methylstyrene, α-chlorostyrene, vinyl xylene and vinyl naphthalene. Styrene and vinyl toluene are especially preferred.

As the acrylic monomer, there can be mentioned acrylic monomers represented by the following formula:

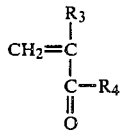

wherein $R_3$ stands for a hydrogen atom or a lower alkyl group, and $R_4$ stands for a hydroxyl group, an alkoxy group, a hydroxyalkoxy group, an amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As the other monomer used singly or in combination with the monomer (a) or (b), there can be mentioned conjugated diolefin monomers represented by the following formula:

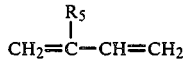

wherein $R_5$ stands for a hydrogen atom, a lower alkyl group or a chlorine atom, such as butadiene, isoprene and chloroprene. Furthermore, there can be mentioned ethylenically unsaturated carboxylic acids such as maleic anhydride, fumaric acid, crotonic acid and itaconic acid, esters of these ethylenically unsaturated carboxylic acids, vinyl esters such as vinyl acetate, vinyl pyridine, vinyl pyrrolidone, vinyl ethers, acrylonitrile, vinyl chloride and vinylidene chloride.

It is preferred that the molecular weight of the above-mentioned vinyl polymer as the binder medium be 3,000 to 300,000, especially 5,000 to 200,000.

In the present invention, it is important that the red azo pigment should be used in an amount of 2.5 to 30 parts by weight, especially 2.5 to 20 parts by weight, and the binder resin should be used in an amount of 40 to 200 parts by weight, especially 60 to 160 parts by weight, per 100 parts by weight of the magnetic powder. If the amount of the azo pigment or binder resin is too large and exceeds the above range, the magnetic attracting force of the developer particles is reduced and fogging or scattering of the toner is caused. If the amount of the azo pigment is too small and below the above range, it is difficult to form a sharp red image having a sufficient concentration of the red developer. If the amount of the binder resin is too small and below the above range, the fixing property is degraded.

In the present invention, the hues and amounts of the foregoing three components are selected so that there is provided a hue distribution in which when a fixed image of the developer is measured by a color difference meter, the value x is from 0.51 to 0.73, the value y is from 0.22 to 0.40 and the value Y is from 5 to 65%. The values x, y and Y are determined according to the colorimetric system CIE, and the value x and y indicate the chromatocity coordinates and the value Y indicates the lightness. This hue distribution corresponds to a pure red color to an orange-tinted red color and is excellent in the combination of the sharpness and the density.

The magnetic developer of the present invention is prepared by kneading the magnetic material and the azo pigment uniformly and homogeneously with the binder medium, pulverizing the kneaded composition and if necessary, classifying the pulverized composition.

Known auxiliary components for the developer may be incorporated according to known recipes prior to the kneading and pulverization of the developer components. For example, at least one oil-soluble dye can be added in an amount of 0.5 to 5% by weight based on the total composition so as to improve the hue of the developer. Furthermore, in order to attain a bulking effect, a filler such as calcium carbonate or finely divided silicic acid may be incorporated in an amount of up to 20% by weight based on the total composition. In the case where the developer is fixed by a heater roll, an offset-preventing agent such as a silicone oil, a low-molecular-weight olefin resin or a wax may be incorporated in an amount of 2 to 15% by weight based on the total composition. When the developer is fixed by a pressure roll, a pressure fixing property-imparting agent such as paraffin wax, animal or vegetable wax or fatty acid amide may be used in an amount of 5 to 30% by weight based on the total composition. In order to prevent cohesion of the developer particles and improve the flowability of the developer particles, a flowability-improving agent such as finely divided polytetrafluoroethylene or finely divided silica may be incorporated in an amount of 0.1 to 1.5% by weight based on the total composition.

The developer of the present invention is prepared by cooling the above-mentioned kneaded composition, pulverizing the kneaded composition and, if necessary, classifying the pulverized composition to a particle size of 5 to 50 microns. Of course, mechanical high-speed stirring may be performed so as to remove the corners of indeterminate particles.

In order to improve the flowability of the magnetic developer, a flowability-imparting agent such as dry method silica may be incorporated in an amount of 0.1 to 1.5% by weight based on the magnetic developer.

The present invention will now be described in detail with reference to the following examples that by no means limit the scope of the invention.

Incidentally, all of "parts" in the examples are by weight unless otherwise indicated.

EXAMPLE 1

50 Parts of gamma-type dirron trioxide (having an apparent density of 1.49 g/ml, a particle size of 0.2 to 1.0 micron, a coercive force of 109 Oe, a saturated magnetization of 69.6 emu/g and a residual magnetization of 5.7 emu/g) was mixed with 0, 2.5, 5, 10, 20 or 40 parts of a red azo pigment A (Pigment Red 5), 35 parts of a thermoplastic resin (a) (styrene-acrylic copolymer having a weight average molecular weight of 51,000), 35 parts of a thermoplastic resin (b) (styrene/acrylic copolymer having a weight average molecular weight of 83,000) and 5 parts of polyethylene (having an average molecular weight of 4,000), and the mixture was melt-kneaded at 140° C. for 1 hour by using a two-roll mill to form a red magnetic toner.

The kneaded composition was naturally cooled and roughly pulverized to a size of 0.5 to 2 mm by a cutting mill, and the roughly pulverized composition was finely pulverized by a jet mill and classified by a zigzag classifier to obtain a red magnetic toner having a particle size of 5 to 25 microns.

The so-prepared red magnetic toner was subjected to the following copying test.

In a copying machine comprising a selenium drum (having an outer diameter of 150 mm) as the photosensitive material, the magnetic toner was supplied on a developing roller in which eight poles were symmetrically arranged in a developing sleeve (having an outer diameter of 33 mm) provided with a magnet therein through a non-magnetic material and the dual rotation system was adopted. The distance between an ear-cutting plate and the developing sleeve was adjusted to 0.3 mm. The magnetic toner was supplied to the developing roller zone from a hopper, and the distance between the surface of the photosensitive material and the developing roller was adjusted to 0.5 mm. The developing sleeve and the photosensitive material were rotated in the same direction and the magnet was rotated in the reverse direction. Under these rotation conditions, charging (+6.7 KV), light exposure, development, transfer (+6.3 KV), heater roller fixation and fur brush cleaning were carried out. The copying speed was adjusted so that 10 copies of a B4 size could be obtained per minute. Wood free paper having a thickness of 80 microns was used as the transfer sheet.

From the results of the above copying test, it was confirmed that when 10 parts of the red azo pigment A was incorporated, an image having a sharpest red color and a higher quality could be obtained. The hues of the obtained copies were measured by a commerically available colorimetric color difference meter (supplied by Tokyo Denshoku K.K.). The obtained results are shown in Table 1.

TABLE 1

| Amount (Parts) of Red Azo Pigment A | Hue Distribution | | |
|---|---|---|---|
| | Value x | Value y | Value Y (%) |
| 0 | 0.48 | 0.45 | 60.2 |
| 2.5 | 0.55 | 0.35 | 37.8 |
| 5 | 0.57 | 0.33 | 24.6 |
| 10 | 0.58 | 0.30 | 10.8 |
| 20 | 0.60 | 0.28 | 9.5 |
| 40 | 0.61 | 0.27 | 8.2 |

From the results shown in Table 1, it is seen that the amount added of the pigment suitable for the hue and image quality of the copy and the magnetic properties of the product toner is in the range of from 2.5 to 20 parts.

The results (image quality) of the copying test are as shown in Table 2.

TABLE 2

| Amount (parts) of Red Azo Pigment A | Fogging | Bleeding | Image Ouality and Hue (General evaluation) |
|---|---|---|---|
| 0 | not caused | not caused | bad |
| 2.5 | not caused | not caused | good |
| 5 | not caused | not caused | good |
| 10 | not caused | not caused | excellent |
| 20 | not caused | slightly caused | good |
| 40 | slightly caused | conspicuous | bad |

EXAMPLE 2

A toner was prepared in the same manner as described in Example 1 except that a red azo pigment B (Pigment Red 48) was used in the red azo pigment A used in Example 1. The toner was subjected to the copying test in the same manner as described in Example 1. The obtained results are shown in Table 3.

TABLE 3

| Amount (parts) of Red Azo Pigment B | Hue Distribution | | |
|---|---|---|---|
| | Value x | Value y | Value Y (%) |
| 2.5 | 0.40 | 0.31 | 50.0 |
| 5 | 0.54 | 0.30 | 20.0 |
| 10 | 0.60 | 0.30 | 10.8 |
| 20 | 0.65 | 0.29 | 8.8 |
| 40 | 0.67 | 0.28 | 7.9 |

As in Example 1, good images free of fogging were obtained when the amount added of the pigment was 2.5 to 20 parts.

I claim:

1. A one-component type red color magnetic developer having a self-electroscopic property, which comprises particles prepared by pulverizing a kneaded composition comprising 100 parts by weight of a magnetic powder composed mainly of ocherous gamma-type diiron trioxide having a number average particle size of 0.2 to 2 microns, 10 to 20 parts by weight of a red azo pigment and 40 to 200 parts by weight of a binder resin, wherein when a fixed image of the particles is measured by a color difference meter, the value x is from 0.51 to 0.73, the value y is from 0.22 to 0.40 and the value Y is from 5 to 65%.

2. A magnetic developer as set forth in claim 1, wherein the red azo pigment is selected from Pigment Red 1 (C.I. 12070), Pigment Red 2 (C.I. 12310), Pigment Red 3 (C.I. 12120), Pigment Red 5 (C.I. 12490), Pigment Red 7 (C.I. 12420), Pigment Red 11 (C.I. 12430), Pigment Red 12 (C.I. 12385), Pigment Red 13 (C.I. 12395), Pigment Red 14 (C.I. 12380), Pigment Red 48 (C.I. 15865), Pigment Red 49 (C.I. 15630) and Pigment Red 60 (C.I. 16015 Lake).

3. A magnetic developer as set forth in claim 1, wherein the binder resin is a homopolymer or copolymer of a vinyl aromatic monomer or an acrylic monomer.

4. A magnetic developer as set forth in claim 3, wherein the vinyl aromatic monomer is selected from styrene, vinyl toluene, α-methylstyrene, α-chlorostyrene, vinyl xylene and vinyl naphthalene.

5. A magnetic developer as set forth in claim 3, wherein the acrylic monomer is selected from acrylic acid, methacrylic acid, ethyl acrylate, methyl methacrylic, butyl acrylate, butyl methacrylate, 2-ethylhexyl acrylate, 2-ethylhexyl methacrylate, 2-hydroxypropyl acrylate, 2-hydroxyethyl methacrylate, 3-aminopropyl acrylate, 3-N,N-diethylaminopropyl acrylate and acrylamide.

6. A magnetic developer as set forth in claim 1, wherein the binder resin has a molecular weight of 3,000 to 300,000.

7. A magnetic developer as set forth in claim 1, wherein the amount of the binder resin is 60 to 160 parts by weight per 100 parts by weight of the magnetic powder.

8. A magnetic developer as set forth in claim 1 wherein the amount of the red azo pigment is about 10 parts by weight per 100 parts by weight of the magnetic powder.

9. A magnetic developer as set forth in claim 1 wherein the value x is from 0.58 to 0.65, the value y is from 0.28 to 0.30, and the value Y is from 8.8 to 10.8%.

* * * * *